US008590820B2

(12) United States Patent
Taylor

(10) Patent No.: US 8,590,820 B2
(45) Date of Patent: Nov. 26, 2013

(54) WASTE DISPOSAL UNIT FOR BIOLOGICALLY HAZARDOUS WASTE

(76) Inventor: James Taylor, Leeds (GB)

( * ) Notice: Subject to any disclaimer, the term of this patent is extended or adjusted under 35 U.S.C. 154(b) by 0 days.

(21) Appl. No.: 13/567,029

(22) Filed: Aug. 4, 2012

(65) Prior Publication Data

US 2013/0032651 A1 Feb. 7, 2013

(30) Foreign Application Priority Data

Aug. 4, 2011 (GB) ..... 1113473.1

(51) Int. Cl.
*B02C 18/22* (2006.01)
*B02C 19/00* (2006.01)
*B02C 23/00* (2006.01)

(52) U.S. Cl.
USPC ..... 241/100; 241/236; 241/285.3

(58) Field of Classification Search
USPC ..... 241/236, 285.1, 285.2, DIG. 38, 285.3, 241/222–225, 100
See application file for complete search history.

(56) References Cited

U.S. PATENT DOCUMENTS

| | | | | |
|---|---|---|---|---|
| 3,750,966 | A | 8/1973 | Anderson | |
| 4,205,794 | A | 6/1980 | Horton et al. | |
| 4,890,733 | A | 1/1990 | Anderson | |
| 5,076,429 | A | 12/1991 | Patrick et al. | |
| 5,580,006 | A * | 12/1996 | Hennenfent et al. | 241/159 |
| 5,813,324 | A | 9/1998 | Lin | |
| 5,934,584 | A * | 8/1999 | Schwelling | 241/285.1 |
| 6,572,037 | B1 * | 6/2003 | Bendzick | 241/36 |
| 7,819,351 | B2 * | 10/2010 | Abramson et al. | 241/99 |
| 7,823,814 | B2 * | 11/2010 | Sued et al. | 241/30 |
| 7,926,749 | B2 * | 4/2011 | Santandrea | 241/24.11 |
| 2003/0168367 | A1 | 9/2003 | Pike | |
| 2005/0269320 | A1 | 12/2005 | Erickson et al. | |
| 2008/0213124 | A1 | 9/2008 | Hengl et al. | |
| 2009/0039183 | A1 | 2/2009 | Wakeman | |

FOREIGN PATENT DOCUMENTS

| | | | |
|---|---|---|---|
| CN | 2500401 | Y | 7/2002 |
| CN | 2539581 | | 3/2003 |
| CN | 2721229 | | 8/2005 |
| EP | 0 545 520 | A1 | 6/1993 |
| EP | 1 314 444 | A1 | 5/2003 |
| EP | 2511252 | A1 | 10/2012 |
| WO | WO 2012/134289 | A | 10/2012 |

OTHER PUBLICATIONS

Search Report Corresponding to Application No. GB1113473.1; Dated: Dec. 7, 2011; 4 Pages.

* cited by examiner

*Primary Examiner* — Faye Francis
(74) *Attorney, Agent, or Firm* — Myers Bigel Sibley & Sajovec, P.A.

(57) ABSTRACT

A waste disposal unit for biologically hazardous waste includes a waste reception mechanism for receiving un-shredded waste, a housing having an interior containing a shredder mechanism and a storage volume for receiving shredded waste from the shredder mechanism. The housing is configured to prevent external access to the interior of the housing. In a first configuration of the waste reception mechanism, un-shredded waste may be received and access from the waste reception mechanism to the interior of the housing is closed. In a second configuration of the waste reception mechanism, access from the exterior of the waste disposal unit into the waste reception mechanism is closed and access from the waste reception mechanism into the interior of the housing is open to permit un-shredded waste to pass from the waste reception mechanism to the shredder mechanism. The waste disposal unit is engaged by a detachable shredder drive mechanism.

12 Claims, 5 Drawing Sheets

WASTE DISPOSAL UNIT FOR BIOLOGICALLY HAZARDOUS WASTE

RELATED APPLICATION

The present application claims priority under 35 U.S.C. §119 to Great Britain Patent Application No. GB1113473.1, filed 4 Aug. 2011 in the Great Britain Intellectual Property Office, the disclosure of which is incorporated herein by reference in its entirety.

FIELD OF THE INVENTION

The present invention relates to waste disposal units for collection of contaminated waste that presents a biological hazard, more particularly a unit suitable for subsequent incineration.

BACKGROUND

Medical procedures typically generate contaminated, hazardous waste materials. Although contaminated metal tools may be sterilised by chemical and thermal treatments for re-use, many other contaminated waste items are not re-used, commonly being designed as disposable items. Such single use hazardous waste items commonly includes so-called "sharps", such as syringe needles.

Contaminated items are commonly collected in dedicated sealed hazardous waste containers for subsequent removal by licensed processors of hazardous waste, who commonly incinerate the waste or melt and dispose of by landfill. Such hazardous waste containers fill quickly, particular when used to collect rigid and/or irregularly shaped items, which necessitates the use of large numbers of containers, requiring a correspondingly large facility for their storage prior to their collection, and significant costs for collection and disposal of such numbers of containers.

SUMMARY

According to a first aspect of the present invention, there is provided a waste disposal unit for biologically hazardous waste comprising: a waste reception mechanism for receiving un-shredded waste, a housing having an interior containing a shredder mechanism and a storage volume for receiving shredded waste from the shredder mechanism, wherein the housing is configured to prevent external access to the interior of the housing, wherein in a first configuration of the waste reception mechanism un-shredded waste may be received from exterior to the waste disposal unit into the waste reception mechanism and access from the waste reception mechanism to the interior of the housing is closed, and wherein in a second configuration of the waste reception mechanism access from the exterior of the waste disposal unit into the waste reception mechanism is closed and access from the waste reception mechanism into the interior of the housing is open to permit un-shredded waste to pass from the waste reception mechanism to the shredder mechanism, and wherein the waste disposal unit is provided with an engagement feature configured to engage with a detachable shredder drive mechanism.

According to a second aspect of the present invention, there is provided a waste disposal system for biologically hazardous waste comprising a waste disposal unit for biologically hazardous waste comprising: a waste reception mechanism for receiving un-shredded waste, a housing having an interior containing a shredder mechanism and a storage volume for receiving shredded waste from the shredder mechanism, wherein the housing is configured to prevent external access to the interior of the housing, wherein in a first configuration of the waste reception mechanism un-shredded waste may be received from exterior to the waste disposal unit into the waste reception mechanism and access from the waste reception mechanism to the interior of the housing is closed, and wherein in a second configuration of the waste reception mechanism access from the exterior of the waste disposal unit into the waste reception mechanism is closed and access from the waste reception mechanism into the interior of the housing is open to permit un-shredded waste to pass from the waste reception mechanism to the shredder mechanism, and a waste disposal system comprising such a waste disposal unit, wherein the waste disposal unit is provided with an engagement feature configured to engage with a detachable shredder drive mechanism, and wherein the waste disposal unit is provided with an engagement feature configured to engage with a detachable shredder drive mechanism, and a detachable shredder drive unit.

The provision of an internal shredder enables the volume of the contaminated waste to be reduced, compared with its pre-shredded volume. Accordingly, this increases the amount by weight of contaminated waste that can be stored in a storage volume, reducing the number of waste storage containers required, and decreasing the corresponding collection and disposal costs.

The provision of an internal shredder to which external access is prevented when the waste disposal unit is in use, not least by a suitable design of waste reception mechanism, may permit the processing of hazardous clinical waste, including hazardous clinical sharps waste, where other forms of clinical waste processing is prohibited (e.g. for reasons of processing operative safety).

All of the materials from which the waste disposal unit is formed are suitable for incineration.

Typical incineration facilities operate at temperatures in excess of 850° C., which is sufficient to adequately process plastics and other combustible waste.

All of the materials from which the waste disposal unit is formed are plastics materials.

The shredder mechanism may comprise shredding teeth that are at least partly metallic. All of the remaining materials from which the waste disposal unit is formed may be plastics materials.

The shredder mechanism may comprise a plurality of rollers or toothed wheels, and be configured to shred waste received between the rollers or wheels.

The shredder mechanism may comprise a plurality of axially elongate shredding rollers.

The shredder mechanism may comprise a wall and one or more rollers or toothed wheels, and be configured to shred waste received between the wall and the one or more rollers or toothed wheels.

The shredder mechanism may be configured to operate only when the waste reception mechanism is in the second configuration.

The waste disposal unit may be provided with a moveable baffle between the waste reception mechanism and the shredder mechanism.

The detachable shredder drive unit may comprise a detachable crank for a user to manually drive the shredder mechanism.

The detachable shredder drive unit may comprise a detachable electrically powered shredder drive unit.

BRIEF DESCRIPTION OF THE DRAWINGS

Embodiments of the invention are further described hereinafter with reference to the accompanying drawings, in which.

DETAILED DESCRIPTION

Figure 1A:
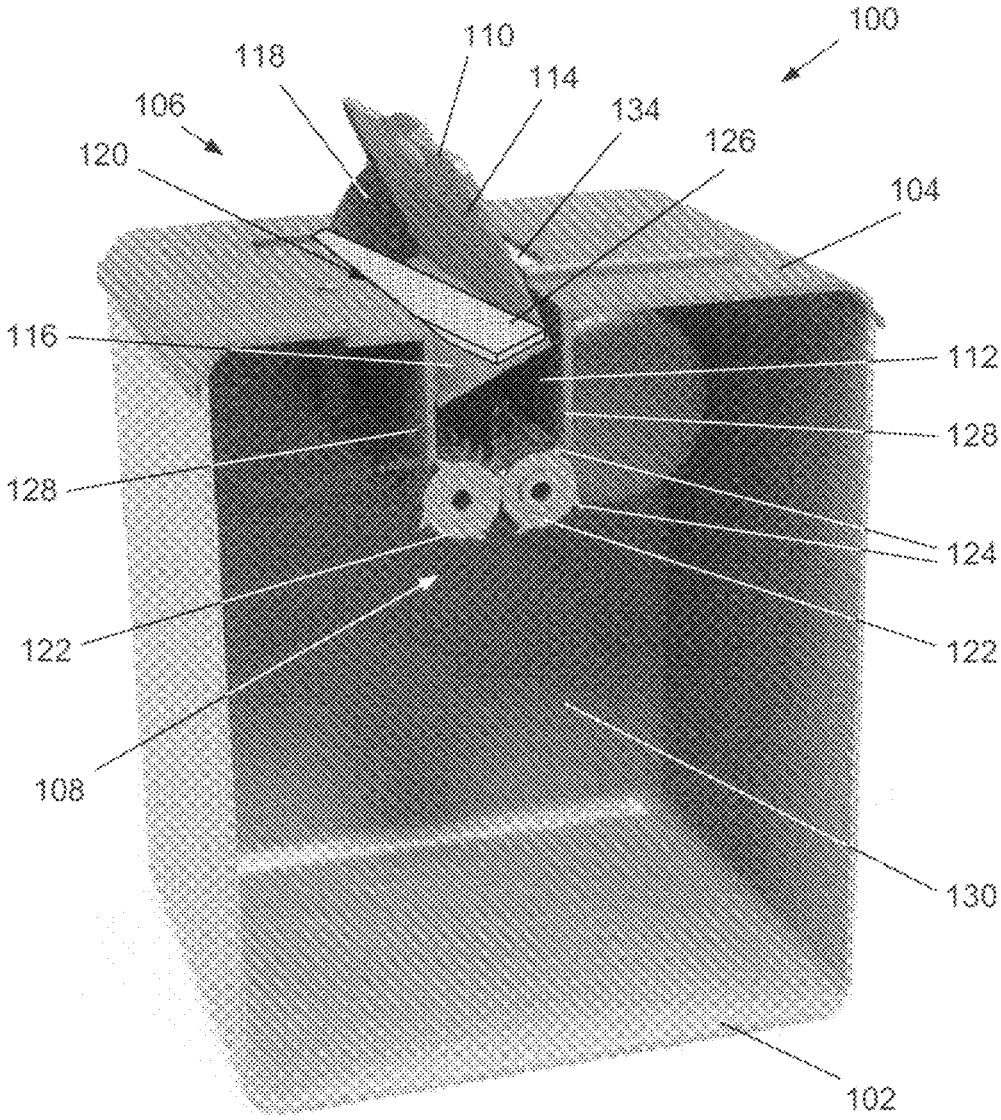
FIG. 1A shows a cut-away view of a waste disposal unit in an open, waste reception configuration.

Like reference numerals refer to like elements throughout.

FIG. 1A illustrates a cut-away view of a waste disposal unit 100, which comprises a housing base 102, a housing lid 104, a waste reception mechanism 106 and a waste shredding mechanism 108.

The housing base 102 comprises an open ended container, and the housing lid 104 covers the opening of the housing base. The waste reception mechanism 106 comprises a receptacle 110 and a waste guiding channel 112. The receptacle 110 is pivotally connected within a waste guiding channel 112 of the housing lid 104 (or alternatively the housing base 102). The receptacle 110 comprises an outer cover 114 connected to an inner baffle 116 and opposed end plates 118.

The waste guiding channel 112 leads from an aperture 120 in the lid 104 to shredding rollers 122 of the waste shredding mechanism 108. The shredding rollers 122 comprise a pair of axially elongate rollers formed of plastics material provided with radially projecting metal teeth 124. The rollers 122 have parallel axes of rotation and are closely spaced apart.

The receptacle 110 is configured to prevent external access to the interior of the housing 102 and 104 through the waste reception mechanism 106 in use, e.g. preventing external access to the shredding mechanism 108 within the interior of the housing 102 and 104.

In use, the outer cover 114 is pivotally raised, like a hatch, for insertion of a biologically contaminated waste item 126 (e.g. hazardous waste, such as sharps waste) into the receptacle 110. The inner baffle 116 is dimensioned to contact a wall 128 of the waste guiding channel 112 when the outer cover is raised, closing external access to the shredding rollers 122.

Figure 1B:
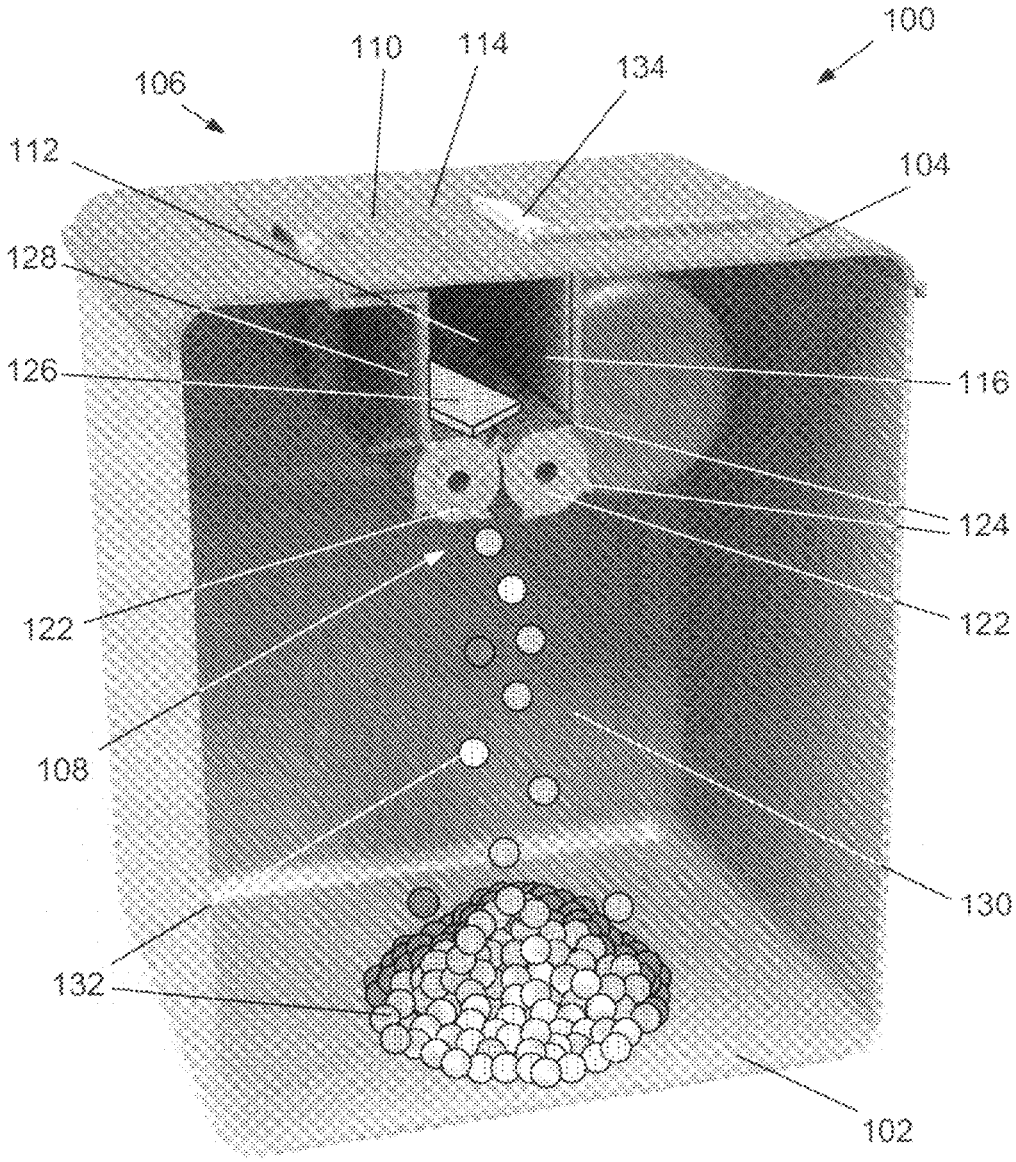
FIG. 1B shows the waste disposal unit of FIG. 1A in a closed configuration ready for waste shredding.

Once the waste item 126 has been received into the receptacle 110, the outer cover 114 is released to re-cover the aperture 120 and close external access to the waste guiding channel 112, as shown in FIG. 1B. When the receptacle 110 pivots back into the closed position, the waste item 126 falls onto the shredding rollers 122. The waste guiding channel 112 guides the waste item 126 to prevent it from falling directly into the storage volume 130 of the unit 100. The waste guiding channel 112 also prevents material from within the storage volume 130 from interfering with movement of the receptacle 110.

To shred the waste item 126, the shredding rollers 122 are each driven to rotate in opposite directions about their respective axes, causing the teeth 124 to reduce the item to small pieces 132 that fall between the rollers into the storage volume 130. Alternatively, just one of the shredding rollers 122 may be driven, and the other shredding roller may be undriven (passive).

Although described with respect to axially elongate rollers 122, alternatively an arrangement of toothed wheels may be used to shred waste objects.

Waste items 126 may be received into the waste shredding mechanism 108 at a wide variety of orientations, for example with elongate waste items being received with a direction of elongation aligned generally parallel to the axes of rotation of the shredding rollers (or toothed wheels), or end-first, perpendicular to the axes of rotation, or more generally transversely (diagonally) aligned relative to the axes of rotation of the shredding rollers.

In the illustrated embodiment, the waste shredding mechanism 108 is provided with two rollers 122. In alternative embodiments there may be more than two rollers (or toothed wheels).

By shredding the waste items 126 into small pieces 132, it becomes possible to store more material within the storage volume 130. The pieces 132 provide a compact arrangement of the waste material. There is a particular benefit in the case of rigid waste items 126, especially irregularly shaped rigid items, which would not or could not otherwise be conveniently and efficiently stacked when dropped into a conventional waste disposal container.

Once the storage volume 130 is sufficiently full, a slideable locking mechanism 134 that is built into the housing 104 is used to lock the outer cover 114, to prevent external access to the guiding channel 112 and further use of the waste disposal unit 100.

The housing 102 and 104, the waste reception mechanism 106, the shredding rollers 122, and any other the components of the waste shredding mechanism 108 that are non-detachable from the housing are made from materials that are suitable for incineration, such as plastics material, albeit with small metallic teeth 124 on the rollers that may be separated out post-incineration.

Accordingly, once the waste disposal unit 100 is sufficiently full, it can be removed and incinerated. Typically the incineration occurs in a furnace operated above 850° C. Alternatively, the waste unit 100 may be melted down into a form that is acceptable for landfill disposal.

Figures 2A, 2B:
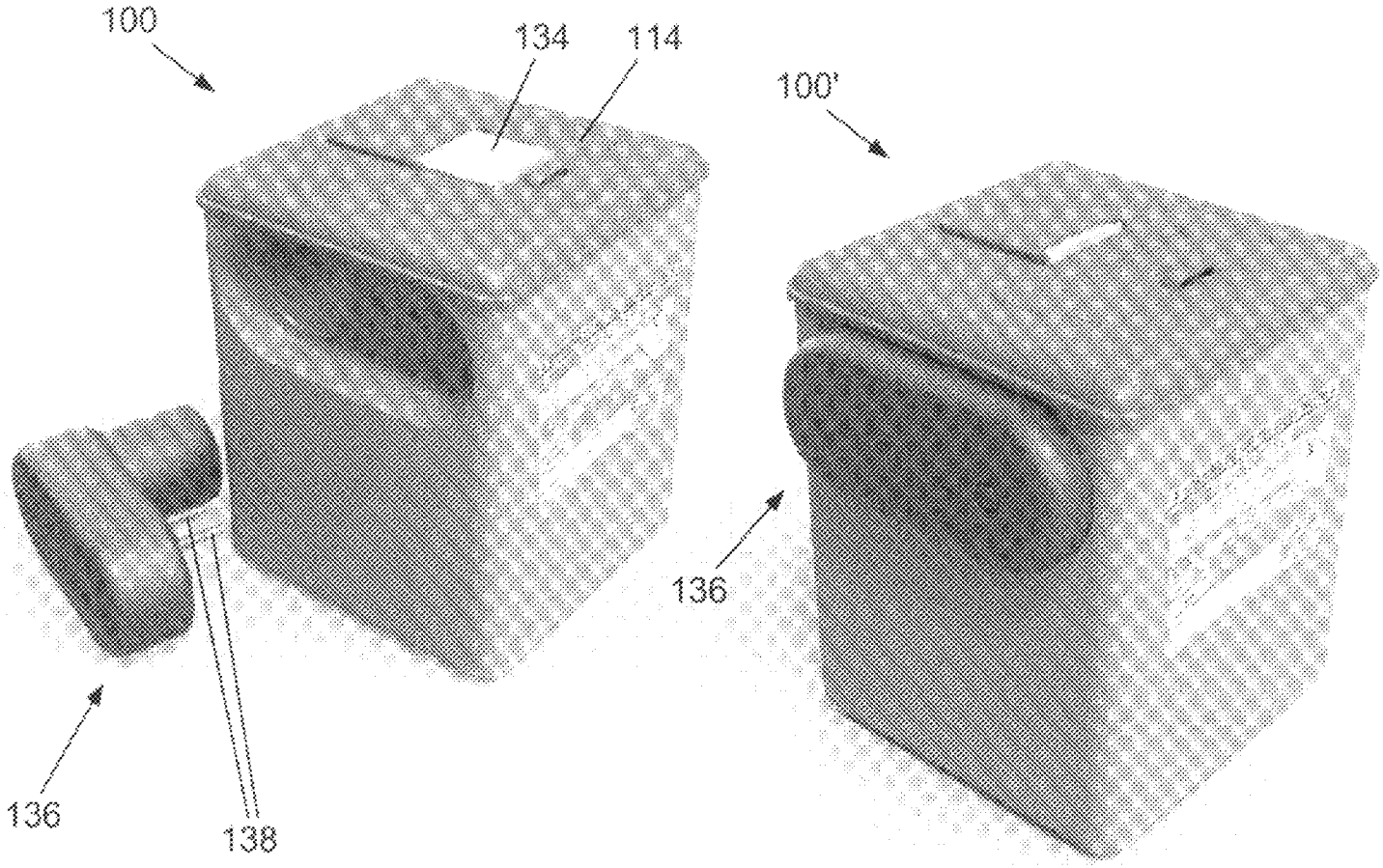
FIG. 2A shows the waste disposal unit of FIG. 1A with a detachable motor unit in the detached configuration.
FIG. 2B shows the waste disposal unit of FIG. 2A in an assembled configuration.

In one embodiment, the waste shredding mechanism 106 is operable by use of a detachable, electrically operated drive mechanism 136, as illustrated in FIGS. 2A and 2B. The electrically operated drive mechanism 136 connects to the housing 102 and 104 and drives the shredding rollers 122. Projecting rotational drive shafts 138 of the electrically operated drive mechanism 136 engage with correspondingly shaped shaft receiving elements 140 (i.e. engagement features) of the shredding rollers 122 and are configured to provide rotational drive to the shredding rollers. The shafts 138 are complementarily shaped to mate with shaft receiving elements 140 of the rollers 122. The shafts 140 may be polygonal in cross-section, or may have splines or a flat running along their length. The drive shafts 138 are mechanically or electrically geared to rotate in opposite directions.

Alternatively, the electrically operated drive mechanism 136 may have a single drive shaft 138 configured to provide rotational drive to the shredding rollers 122, with a gearing mechanism connected to the housing 102 and 104, to gear the relative rotation of the rollers. The shaft receiving element may be part of a shredding roller 122 (or toothed shredding wheel) or may be geared with such a roller.

The electrically operated drive mechanism 136 is detachable from the housing 102 and 104. Accordingly, once the storage volume 130 of a unit 100 is sufficiently full, the electrically operated drive mechanism 136 is detached from the housing 102 and 104, as illustrated in FIG. 2A, ready for the drive mechanism to be connected to a further unit 100', as illustrated in FIG. 2B.

Figure 3:
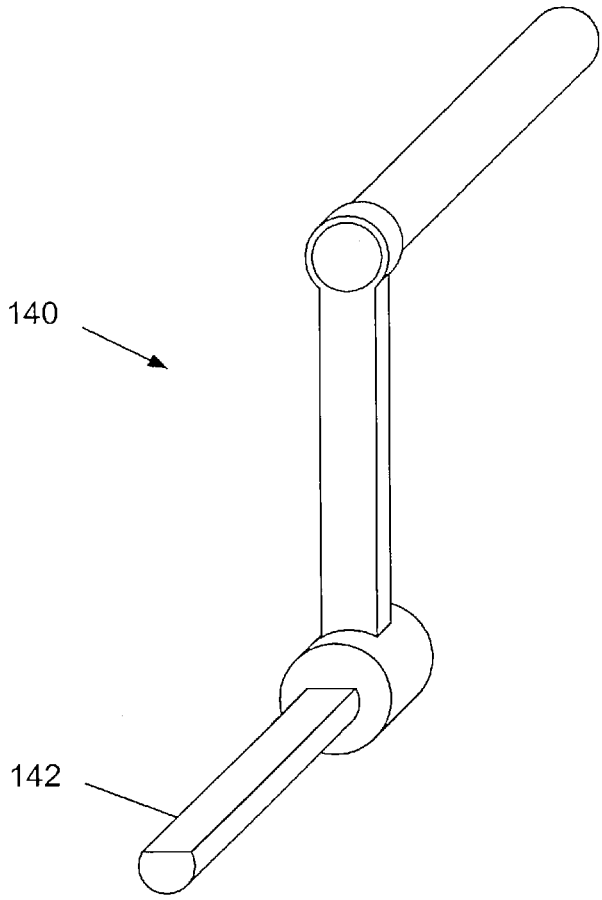
FIG. 3 shows a detachable manual crank for a waste disposal unit.

In an alternative embodiment, the waste shredding mechanism 106 is configured to be manually driven, being provided with a manual crank 142. FIG. 3 illustrates a manual crank 140 having a single rotational drive shaft 144, that is configured to engage with a drive shaft receiving element of a shredding roller 122 and/or a gearing mechanism (not illustrated) to provide the rotational drive to each of the rollers.

The manual crank 142 is detachable from the housing 102 and 104 for re-use with alternative further waste disposal units 100.

In an alternative embodiment, the manual crank 142 may be non-detachably connected to the engagement feature of the waste disposal unit 100, and is made of materials suitable for incineration, such as plastics.

Figure 4A:
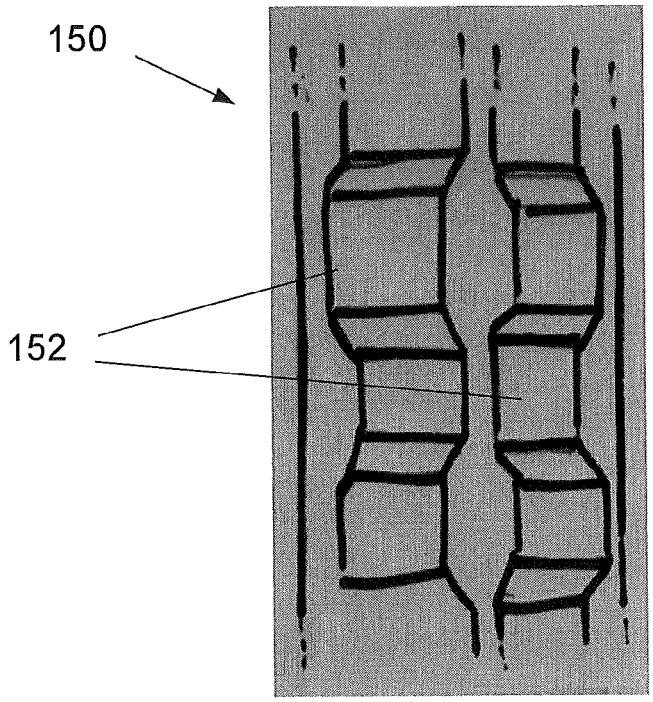
FIG. 4A shows a profiled wall.
Figure 4B:
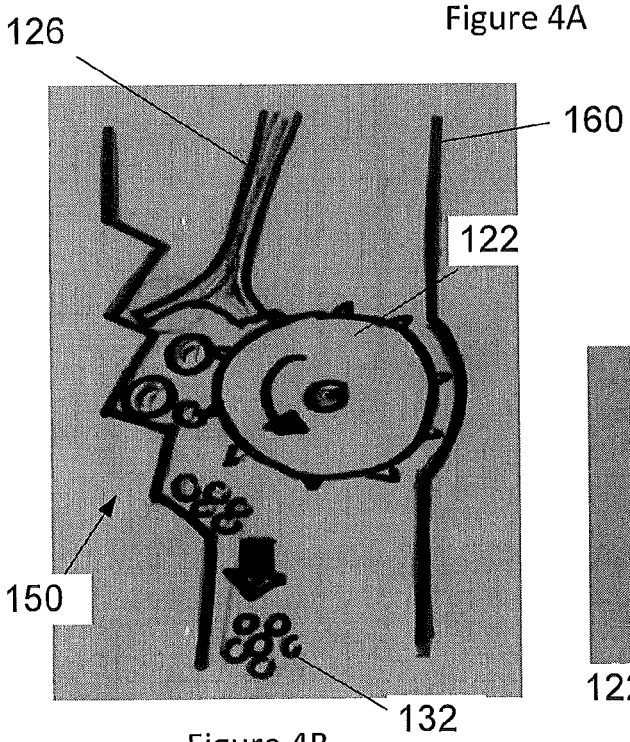
FIGS. 4B and 4C show side and plan views of shredding mechanisms using the profiled wall of FIG. 4A.
Figure 4C:
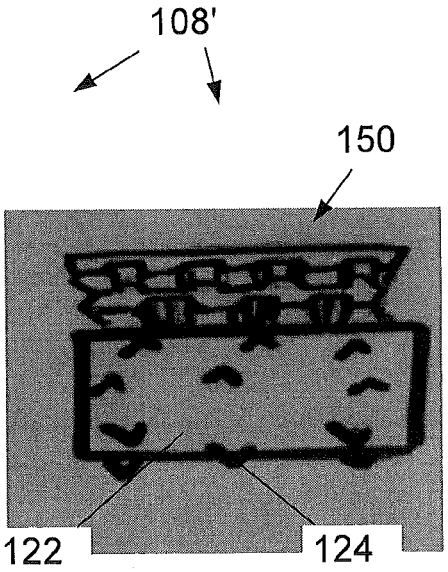

Although the embodiment illustrated in FIG. 1B has a shredding mechanism in which waste is shredded that falls between rollers, alternatively, one or more rollers (or toothed wheels) may be provided adjacent a wall, such that waste received between the one or more rollers and the wall is shredded. Advantageously the wall has a surface profile to enhance engagement between the wall and the waste objects to be shredded. FIG. 4A show a portion of such a profiled wall 150, which comprises an arrangement of tooth-like projections (or serrations) 152. FIGS. 4B and 4C illustrate a corresponding shredding mechanism 108' in which waste 126 is shredded between a single toothed roller 122 and the profiled wall 150.

The housing base 102 and housing lid 104 are non-detachably sealed together, or are manufactured as a single component, to prevent external access to the shredder mechanism 108 and the shredded pieces 132 stored within the storage volume 130. Such an arrangement is suited to waste disposal units 100 that will be disposed of by incineration.

Alternatively, the housing 102 and 104 may be lockable together to prevent external access to the interior of the housing in use. Such an arrangement may be suitable for a waste disposal unit 100 that is adapted to be emptied, cleaned, sterilised and re-used.

Although the waste reception mechanism has been described with respect to a pivotable receptacle, other arrangements of waste reception mechanism are possible, such as a receptacle or outer cover that is slideably connected to the housing for opening and closing.

The housing lid 104 is sealed to the housing base 102 to prevent access to the interior of the waste disposal unit 100. Alternatively, the housing lid 104 may be lockable to the housing base 102 to prevent access to the interior of the unit 100 during use.

To reduce the possibility of contamination being released from within the housing, an additional moveable baffle (not illustrated) may be provided within the waste guiding channel between the receptacle or outer cover and the shredding rollers, to prevent contamination issued from the rollers from transferring to the receptacle. The additional baffle is arranged to open the waste guiding channel to permit the waste to pass from the receptacle to the shredding rollers, for example operation of a cam connected to the pivotable receptacle, or by manual operation of a release control (e.g. a release button that moves the further baffle to an open configuration against the action of a biasing element, such as a spring).

The waste reception mechanism may be configured to be operable only when the outer cover is in the closed position. For example a cam and brake arrangement may be used to prevent rotation of the shredding rollers when the outer cover is in the open position. Alternatively, a clutch mechanism may disconnect the rotational drive engagement features from the shredding rollers when the outer cover is in open position. In a further alternative, the electrically operated drive mechanism may be provided with a drive over-ride switch that is operable by a feature of the receptacle, such that rotational drive of the electrical drive mechanism may only be enabled when the outer cover is closed.

To further reduce contamination within the waste guiding channel, a sanitation system may be provided that releases a spray of sanitising fluid into the waste guiding channel.

The figures provided herein are schematic and not to scale.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

That which is claimed is:

1. A waste disposal unit for biologically hazardous waste comprising:

a waste reception mechanism for receiving un-shredded waste, a housing having an interior containing a shredder mechanism and a storage volume for receiving shredded waste from the shredder mechanism, wherein the housing is configured to prevent external access to the interior of the housing, wherein the waste reception mechanism comprises a pivotable receptacle and a waste guiding channel, the receptacle comprising an outer cover and a moveable inner baffle that are connected along a common edge for receiving waste within the receptacle between the outer cover and inner baffle, and wherein the waste guiding channel leads from an aperture in the housing to the shredder mechanism, wherein in a first orientation of the receptacle un-shredded waste may be received from exterior to the waste disposal unit through the aperture and into the receptacle and access from within the receptacle to the interior of the waste guiding channel is closed by the moveable inner baffle, and wherein in a second orientation of the receptacle access from the exterior of the waste disposal unit into the receptacle is closed and access from within the receptacle into the waste guiding channel is open to permit un-shredded waste to pass from within the receptacle to the shredder mechanism, and wherein the waste disposal unit is provided with an engagement feature configured to engage with a detachable shredder drive mechanism.

2. A waste disposal unit according to claim 1, wherein all of the materials from which the waste disposal unit is formed can be incinerated at a temperature of 850° C. or higher.

3. A waste disposal unit according to claim 1, wherein all of the materials from which the waste disposal unit is formed are plastics materials.

4. A waste disposal unit according to claim 1, wherein the shredder mechanism comprises shredding teeth that are at least partly metallic.

5. A waste disposal unit according to claim 4, wherein all of the remaining materials from which the waste disposal unit is formed are plastics materials.

6. A waste disposal unit according to claim 1, wherein the shredder mechanism comprises a plurality of rollers or toothed wheels, and is configured to shred waste received between the rollers or wheels.

7. A waste disposal unit according to claim 6, wherein the shredder mechanism comprises a plurality of axially elongate shredding rollers.

8. A waste disposal unit according to claim 1, wherein the shredder mechanism comprises a wall and one or more rollers or toothed wheels, and wherein the shredder mechanism is configured to shred waste received between the wall and the one or more rollers or toothed wheels.

9. A waste disposal unit according to claim 1, wherein the shredder mechanism is configured to operate only when the waste reception mechanism is in the second configuration.

10. A waste disposal system for biologically hazardous waste comprising a waste disposal unit according to claim 1 and a detachable shredder drive unit.

11. A waste disposal system according to claim 10, wherein the detachable shredder drive unit comprises a detachable crank for a user to manually drive the shredder mechanism.

12. A waste disposal system according to claim 10, wherein the detachable shredder drive unit comprises a detachable electrically powered shredder drive unit.

* * * * *